United States Patent [19]

Reist et al.

[11] 4,274,623

[45] Jun. 23, 1981

[54] METHOD AND APPARATUS FOR STACKING PRINTED PRODUCTS CONTINUOUSLY ARRIVING IN A SUBSTANTIALLY FISH SCALE OVERLAPPING ARRANGEMENT

[75] Inventors: Walter Reist, Hinwil; Werner Honegger, Rüti, both of Switzerland

[73] Assignee: Ferag AG, Hinwil, Switzerland

[21] Appl. No.: 87,093

[22] Filed: Oct. 22, 1979

Related U.S. Application Data

[63] Continuation of Ser. No. 578,357, May 16, 1975, abandoned.

[30] Foreign Application Priority Data

May 28, 1974 [CH] Switzerland ..... 7234/74

[51] Int. Cl.[3] ..... B65H 31/04; B65H 31/10

[52] U.S. Cl. ..... 271/217; 271/213; 414/54; 414/65; 414/88

[58] Field of Search ..... 198/422, 423, 431; 271/213, 147, 217, 162, 201, 164, 216, 194, 69, 9; 270/58; 93/93 R; 414/54, 65, 66, 88, 87

[56] References Cited

FOREIGN PATENT DOCUMENTS 243690 11/1963 Austria ..... 271/9

*Primary Examiner*—Robert B. Reeves
*Assistant Examiner*—Douglas D. Watts
*Attorney, Agent, or Firm*—Werner W. Kleeman

[57] ABSTRACT

A method of stacking printed products continuously arriving in a fish scale overlapping arrangement wherein the fish scale stream of products is transformed into a substantially spiral-shaped stack by deflection of the arriving printed products in their plane, the spiral-shaped stack of printed products bearing against one another. There is also disclosed apparatus for the performance of the method wherein following the outfeed end of a conveyor line for the fish scale product stream there is provided a revolving stack support. Deflecting means for the arriving printed products coact with the revolving stack support. The outfeed end of the conveyor line and the stack support are movable relative to one another in the direction of the axis of rotation of the stack support.

7 Claims, 9 Drawing Figures

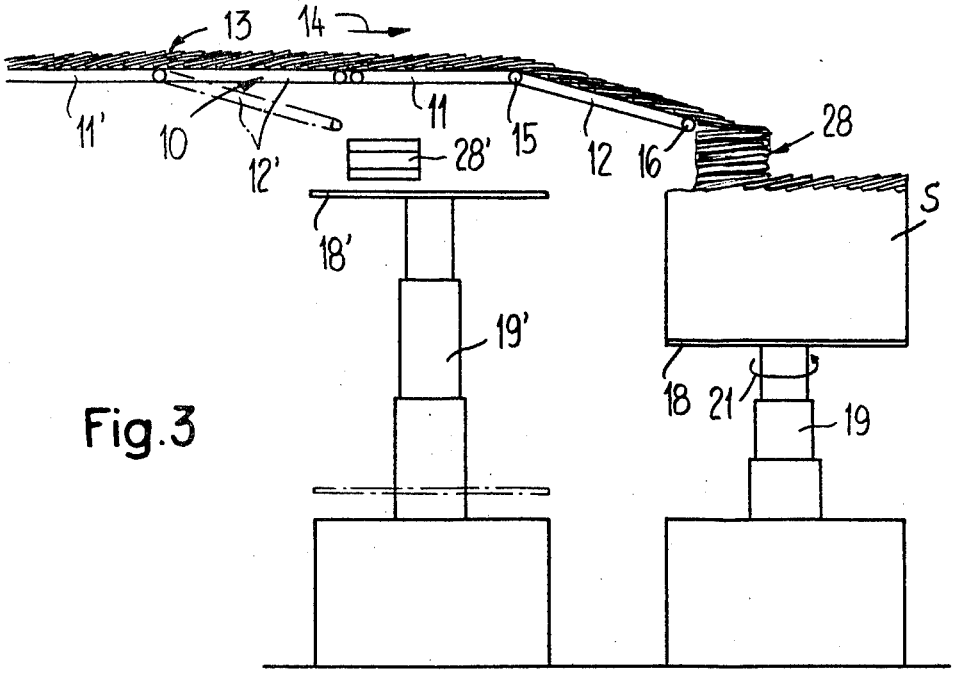
Fig.3
Fig.6
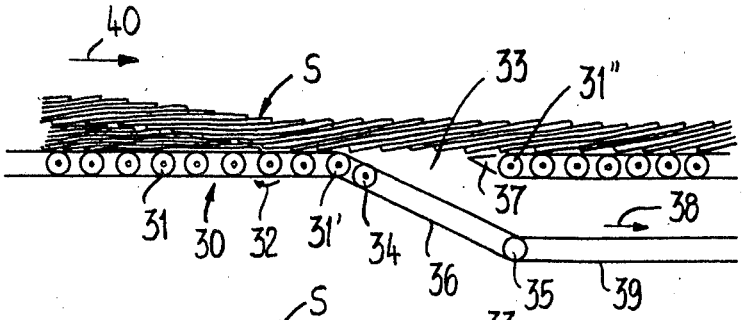
Fig.7
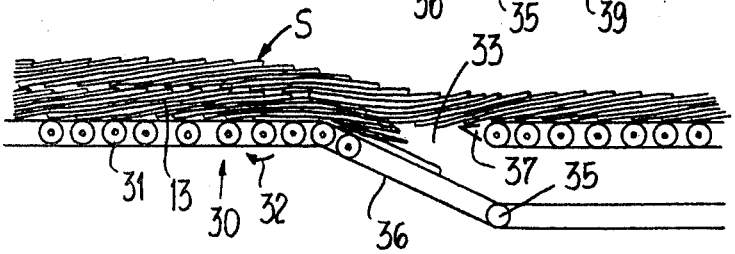
Fig.8
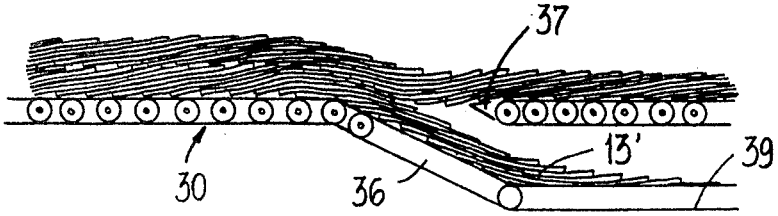

METHOD AND APPARATUS FOR STACKING PRINTED PRODUCTS CONTINUOUSLY ARRIVING IN A SUBSTANTIALLY FISH SCALE OVERLAPPING ARRANGEMENT

CROSS-REFERENCE TO RELATED CASE

This is a continuation application of my commonly assigned copending U.S. application Ser. No. 578,357, filed May. 16, 1975, now abandoned.

BACKGROUND OF THE INVENTION

The present invention relates to a new and improved method of stacking printed products which continuously arrive in a substantially imbricated or fish scale overlapping arrangement, and furthermore, pertains to a new and improved construction of apparatus for the performance of the aforesaid method as well as to a stack produced in accordance with such method and the use of such method.

In the context of this disclosure the expression "fish scale" arrangement or "fish scale" overlapping arrangement of products or articles is intended to mean an arrangement of substantially flat structures which are disposed in an overlying spread formation, in other words, in the manner of a fanned deck of cards.

With conventional stacking techniques of the aforementioned general type, the fish scale product stream is eliminated and transformed essentially into a stack of quadratic configuration wherein the printed products practically completely mutually cover one another in superimposed formation.

It should be relatively self-evident that such essentially quadratic-shaped stack, with the present day output of rotary printing presses, grows quite rapidly in height, this being particularly the case when handling thick printed products, for instance, voluminous newspapers or the like. On the other hand, it should be equally apparent that a conventional stack cannot be built-up to any random desired height. Also, it is to be appreciated that is an essential requirement with respect to rationalization of the processing operations that the printed products which arrive in the fish scale arrangement should be brought into a configuration or formation which in its entirety can be stored, transported and handled. This is so because, for instance, a voluminous newspaper cannot be produced during a single pass through the rotary printing press, rather as a general rule there are required a number of production steps which are staggered in time, and in the last production step there is formed the topical section of the printer product (the so-called main product and in the case of newspapers the outermost section bearing usually the most newsworthy items) which then is combined, typically by carrying out a stuffing operation, with the previously formed sections (the so-called pre-products or intermediate sections in the case of a newspaper) into the actual newspaper copy.

However, the developments which have occurred in this particular field of technology up to the present time have not gotten away from the formation of the conventional, approximately quadratic-shaped stack. This factor combined with the increasing output capacity of rotary printing presses has resulted in the fact that a single one of the classical stackers, notwithstanding the measures undertaken to increase the efficiency or output thereof and associated with considerable technological expenditure (for instance shortening the ejection times of the finished formed stacks and increasing the stack height, possibly, with the aid of a cartridge-like truss or the like), is hardly capable of stacking in a disturbance free manner the entire output of a rotary printing press.

Apart from the foregoing there is an additional factor which must be considered, to wit: the printed products stacked into conventional quadratic-shaped stacks (with or without the aid of stack cartridges) oftentimes require a further handling (e.g. insertion of the pre-product into the main product), so that as a rule the stack again must be transformed into a fish scale stream or overlapping arrangement. However, such practically cannot be carried out without previously separating the stack, and for this purpose there are required technically complicated devices, such as for instance feeding apparatus.

SUMMARY OF THE INVENTION

It is a primary aim of the present invention to get away from the preconception that there must be produced a conventional quadratic-shaped stack and to provide a stacking method, and an apparatus for the performance thereof, wherein the printed products are nonetheless as before "stacked", but without completely losing the original fish scale formation.

The resultant product of this method is a coherent, uniform and stable stack in the broadest sense of the word, which for the same height as a conventional essentially quadratic- shaped stack as previously discussed, contains in comparison thereto a considerably greater number of printed products, in fact a multiple number of printed products.

Still a further significant object of the present invention aims at providing an improved method of, and apparatus for, stacking articles, typically printed products, such as newspapers, continuously arriving in a fish scale or imbricated arrangement into a novel configured stack of spiral-like shape.

Yet a further object of the invention is concerned with the formation of such spiral-shaped stack in a quick, reliable and efficient manner at speeds wherein the stacking apparatus can readily take-up the output of even the most modern day high speed rotary printing presses of the like.

Now in order to implement these and still further objects of the invention, which will become more readily apparent as the description proceeds, the proposed method of this development is manifested by the features that the fish scale stream of products is transformed into a substantially spiral-shaped stack by the deflection of the arriving printed products in their plane, and wherein the printed products in the spiral-shaped stack bear against one another.

As already alluded to above the invention is not only concerned with the aforementioned method aspects but also relates to a new and improved construction of apparatus for the performance thereof, and which apparatus is manifested by the features that following the outfeed or the discharge end of a conveyor line for the fish scale stream of products there is provided a revolving stack support. Deflecting means for the incoming or arriving printed products are provided for the stack support, the outfeed of the conveyor line and the stack support being movable relative to one another in the direction of the axis of rotation of the stack support.

Finally, there is also proposed according to the invention the use of the method aspects of this development for producing a transportable stored unit of components of a multi-part printed product, especially a newspaper.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 is a schematic side view of a twin arrangement of the apparatus shown in FIGS. 1 and 2;

FIGS. 6, 7 and 8 are respective schematic development views of an apparatus which can be employed for transforming the stack produced according to the method of this invention back again into a fish scale formation.

DETAILED DESCRIPTION OF THE INVENTION

Figure 1:
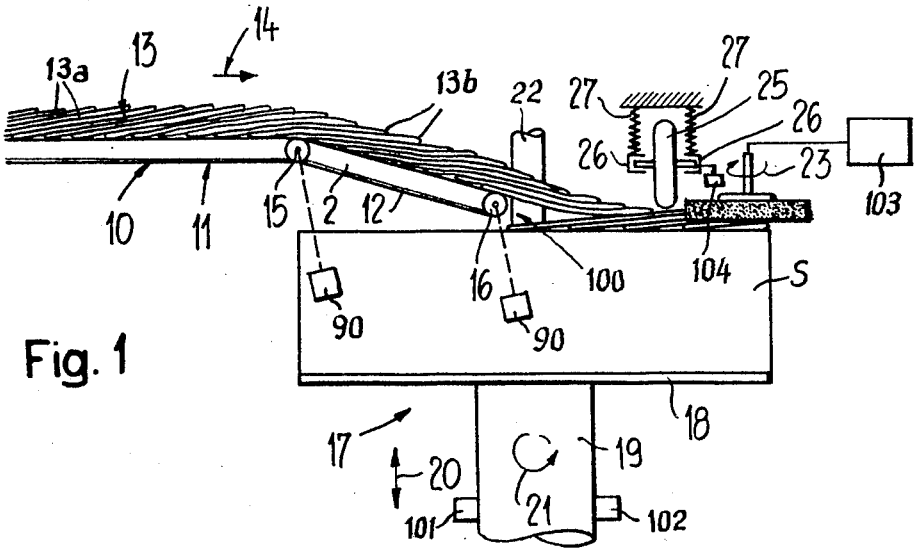
FIG. 1 is a schematic illustration in side view of an apparatus as contemplated according to the invention for transforming a fish scale product stream into a spiral-shaped stack.
Figure 2:
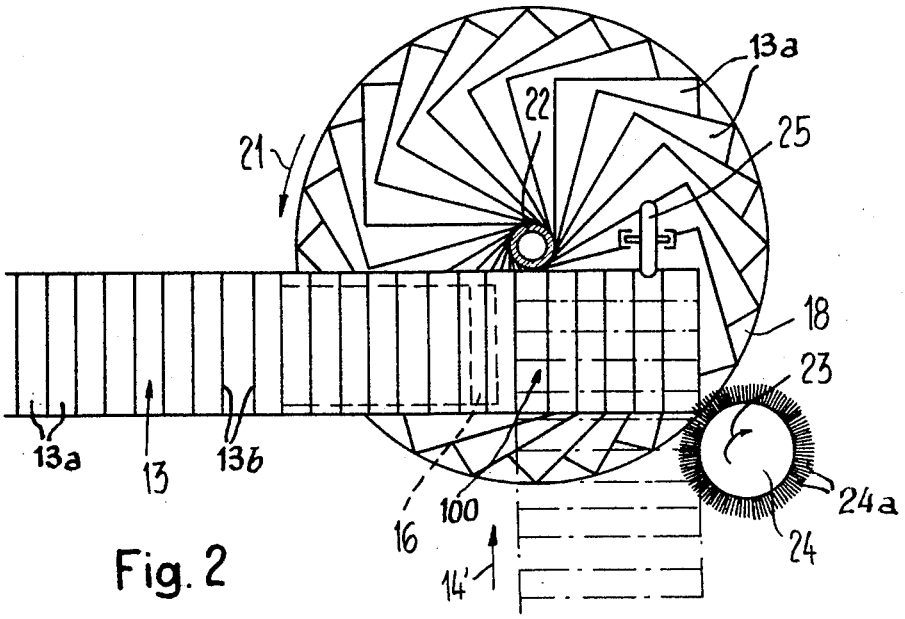
FIG. 2 is a schematic illustration in plan view of the apparatus depicted in FIG. 1.

Describing now the drawings, in the exemplary illustrated embodiment of apparatus depicted in FIGS. 1 and 2 there will be recognized the terminal region of a conveyor line 10 composed of a horizontal conveyor band 11 or equivalent structure and an inclined conveyor band 12 which is arranged following the conveyor band 11. Upon both of the conveyor bands 11 and 12 there is conveyed a fish scale or imbricated product stream 13 in the direction of the arrow 14. With the aid of conventional and therefore only schematically illustrated means 90, the deflection or deflecting rollers 15, 16 of the illustrated conveyor bands 11 and 12 are stationarily mounted and driven, so that there is derived a product conveying direction indicated by the aforementioned arrow 14. In the arrangement under discussion the deflecting roller 16 forms the outfeed or discharge end, generally indicated by reference character 100 (FIG. 2) of the conveying or conveyor line 10. Beneath this outfeed 100 of the conveyor line 10 there is arranged a stack support or stack support means 17. This stack support 17 essentially embodies a circular platform 18 which, in turn, is supported upon a column 19. As will be described more fully hereinafter in conjunction with the apparatus arrangement portrayed in FIG. 3 the column 19 and thus the platform 18 can be lowered and raised, as desired, in the directions of the double-headed arrow 20 and also can be rotatably driven, for instance in the direction of the arrow 21. To that end there can be provided any suitable drive means, such as the schematically illustrated drive 101 for elevationally adjusting the position of the column 19 and the platform 18 and the schematically illustrated drive 102 which can be employed to rotate the column 19 and the thereby supported platform 18 in the direction of the arrow 21. As best seen by referring to FIG. 2, the diameter of the platform 18 amounts to more than twice the width of the fish scale stream 13 of products and also more than twice the length of the deflecting roller or roll 16.

A tube or pipe member 22 forming a type of "stack core" is detachably mounted at the central region of the platform 18. At the region of the uppermost position which the platform or platform member 18 can assume there is operatively associated with the outfeed or outlet end 100 of the conveyor line 10 a deflection element which in this instance is shown in the form of a disk brush 24 driven by the schematically indicated drive means 103 in the direction of the arrow 23. The disk brush 24 is provided with the circumferentially arranged bristles 24*a* or the like. The rotational speed of the platform 18 and that of the disk brush 24 are chosen such that the peripheral speeds of the platform 18 and the disk brush 24 approximately correspond to one another and, in turn, are somewhat greater than the conveying speed with which there arrive the fish scale product stream 13.

There is also clearly seen by referring to FIGS. 1 and 2 the outlet or discharge 100 of the conveyor line 10 is additionally provided with a rotatable contact or pressure roll 25, the axis of rotation of which extends approximately perpendicular to the axis of rotation of the platform 18 and parallel to the conveying direction 14 of the incoming fish scale product stream 13. This contact or pressure roll or roller 25 can be driven by any suitable drive means, such as the drive means 104, in order to assist or replace the drive of the column 19 and the platform 18. The bearing means 26 of the contact roller or roll 25 are subjected to the action of a pre-biasing force acting towards the platform 18, and in the arrangement under discussion this pre-biasing force is realized by the action of the springs 27 or equivalent structure.

Having now had the benefit of the foregoing discussion of the apparatus structure portrayed in FIGS. 1 and 2 its mode of operation will be considered and is as follows: It is assumed that the platform 18 is in its highest elevational position i.e., that it almost contacts the pressure roll or roller 25. The platform 18 is placed into rotation by its drive or drive means 102, and equally the disk brush 24 is placed into rotation by its drive means 103. The fish scale product stream 13 which arrives via the conveyor band 12 or the like spills over onto the platform 18 where it initially still arrives to move further in the same direction as the delivery direction of the conveyor bands or belts 11, 12 (i.e. in the direction of the arrow 14). As soon as the leading or forwardmost copy of the fish scale product stream 13, in other words the copy located at the right-hand side of FIG. 2, arrives at the path of movement of the bristles 24*a* of the disk brush 24, then such product copy is deflected out of the fish scale product stream 13 and arrives beneath the contact or pressure roller 25, so that it positively comes to bear at the platform 18. The same happens with the next following product copy, so that the fish scale product stream 13, as illustrated in FIG. 2, is continuously fanned-out in its own plane, while the platform 18 gradually lowers in accordance with the increasing thickness of the fanned- or spread-out fish scale product stream. The structure which is formed after a number of revolutions of the platform or platform member 18 has been shown in perspective view in FIG. 4. The substantially rectangular printed products 13*a* of the fish scale product stream 13 and illustrated in full lines in FIG. 2 are delivered with their narrow edge 13*b* leading upon the conveyor line 10. This means, for instance, that in the case of a newspaper which has been folded once, that the fold along the one side edge, preferably along the edge of the fish scale product stream 13 appearing at the top of FIG. 2, will be delivered. This does not correspond to the form of the fish scale stream which directly arrives out of a rotary printing press. With such form of the fish scale product stream the printed products are located with their lengthwise side transverse to the conveying direction and the leading fold overlaps the preceding printed product. Also such fish scale formation can be stacked into a "spiral-shaped stack" with the illustrated apparatus, as such has been shown in FIG. 2 by phantom lines and with the arrow 14'. In this instance the disk brush 24 can be dispensed with and the driven contact or pressure roller 25 in conjunction with the tube 22 which in this case acts as a stop or impact means assumes the function of the deflecting element. The structure which is formed with this arrangement is practically the same as illustrated in FIG. 4.

Figure 3A:
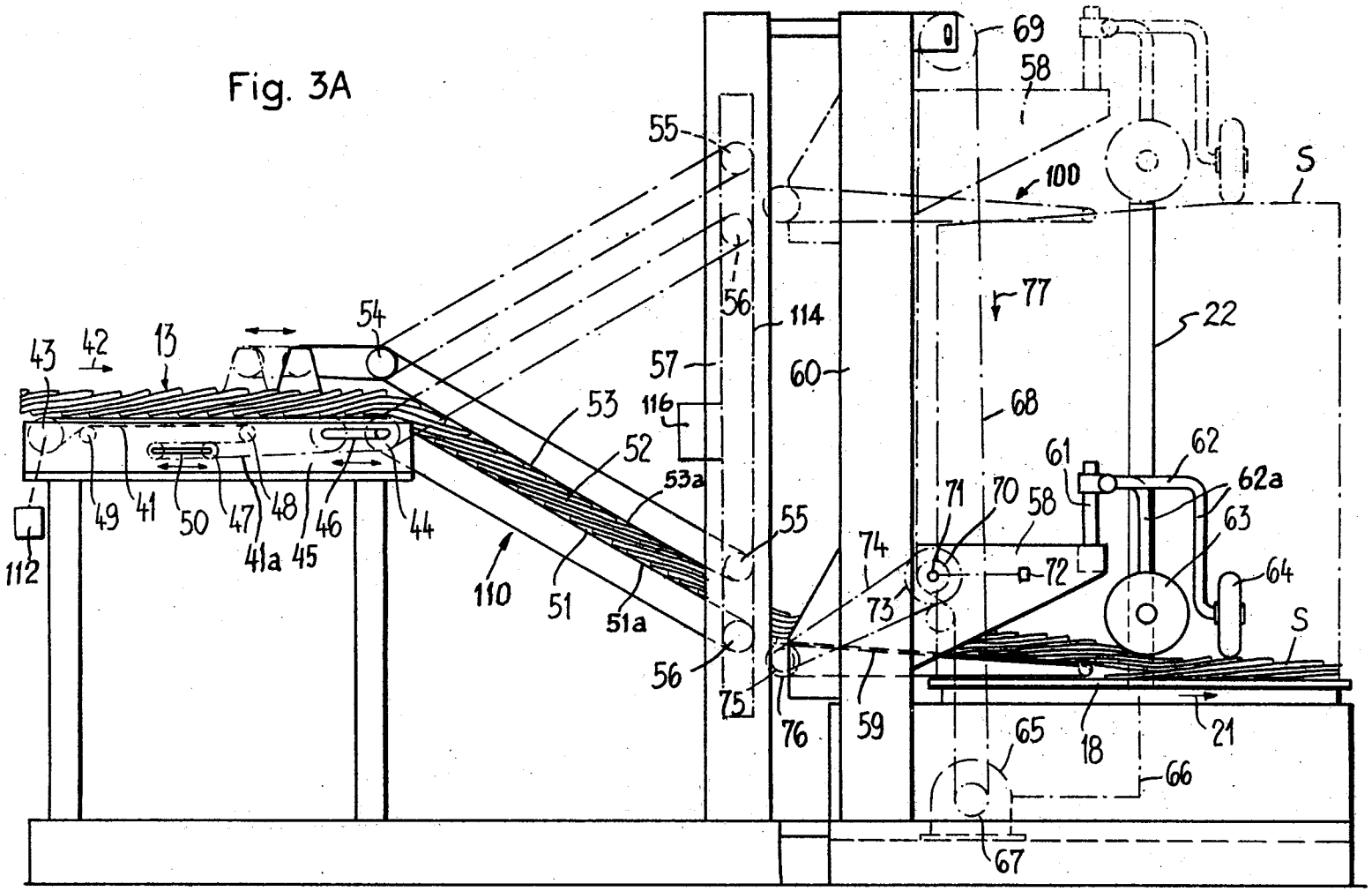
FIG. 3A is a schematic illustration of a variant embodiment of apparatus for the performance of the method of this invention.
Figure 4:
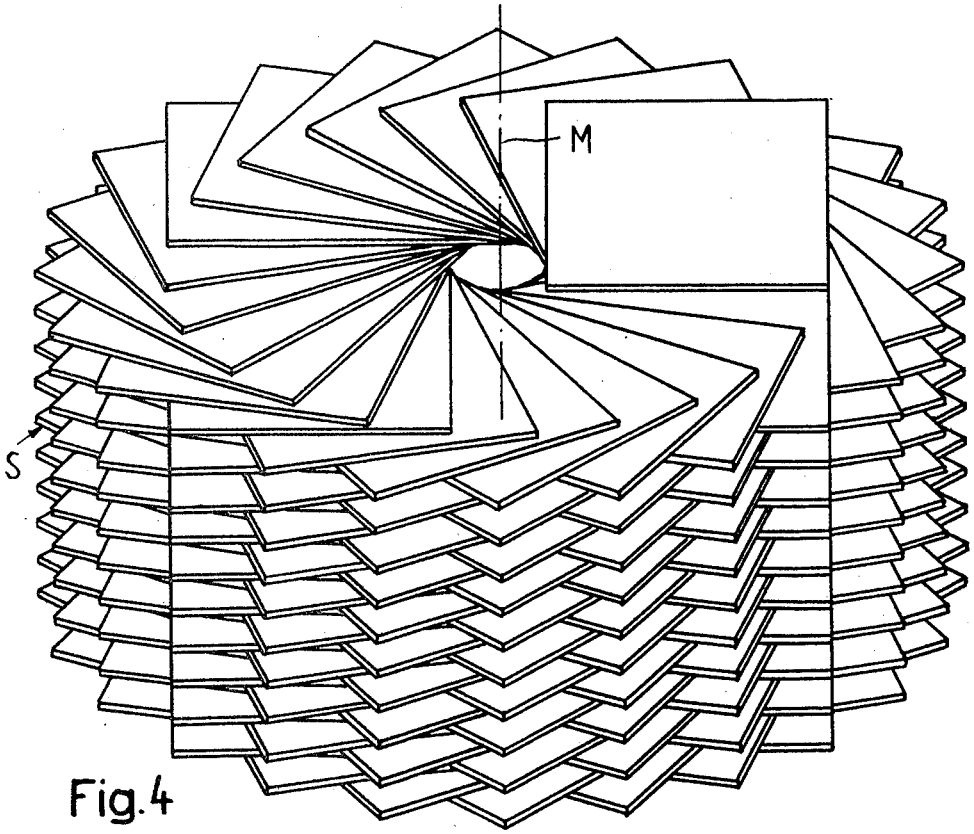
FIG. 4 is a perspective view of an exemplary substantially spirally-shaped stack of products, typically printed newspapers, produced with the apparatus constructions depicted in FIGS. 1, 2, 3 and 3A.

Continuing, in FIG. 3 there is illustrated a twin arrangement of the apparatus portrayed in FIGS. 1 and 2 by means of which is it possible to continuously form a structure of the type shown in FIG. 4 from an incoming or arriving fish scale product stream 13. In order to simplify the illustration of FIG. 3 the drive means for elevationally displacing each column arrangement and associated platform and for rotating the same have been conveniently omitted from the drawing, it being understood that suitable drive means as heretofore disclosed in conjunction with the embodiment of FIGS. 1 and 2 can be readily employed. Again referring to FIG. 3 there will be recognized the conveyor or conveying line 10 which, in this case,—viewed with respect to the conveying direction indicated by the arrow 14—comprises a conveyor band or belt 11' or equivalent structure and at which there merges a conveyor band rocker or pivotal portion 12' which can be deflected out of an essentially horizontal position into an inclined position as shown in phantom lines, as well as the conveyor band or belt 11 with the thereat merging inclined conveyor band or belt 12 or the like. Both at the conveyor band rocker or pivotal portion 12' as well as also at the inclined conveyor band 12 there merges a further inclined conveyor band 28' and 28 respectively, the conveying direction of each of which extend at right angles to the conveying direction, indicated by the arrow 14, of the fish scale product stream 13. Owing to this right angle deflection of the fish scale product stream 13 such is transformed in such a manner that the printed products come to lie with their fold parallel to the conveying direction 14. By any suitable and therefore not particularly illustrated means it is possible to bring the conveyor band rocker or pivotal portion 12' out of the position which is in alignment with the conveyor bands 11' and 11 into the inclined position shown in phantom lines. As long as the conveyor band rocker 12' is in its raised position, then there is serviced the platform 18, and when the conveyor band rocker 12' is lowered, then the infeed of the fish scale product stream 13 to the conveyor band 11 and thus to the platform 18 is interrupted, whereas now there is serviced via the conveyor band 28' the platform 18' situated below such last-mentioned conveyor band 28' or the like. This platform or platform member 18', just as is the case for the platform 18, is also mounted upon a column or column arrangement 19'. In this instance both of the column arrangements 19 and 19' are constructed as telescopic columns which can be hydraulically raised in elevation or retracted, as required. If it is recognized that a spiral-shaped stack S of printed products as shown in FIG. 4 consists of many hundreds of printed products before its inherent stability even begins to become questionable, there is realized the beneficial result for the twin arrangement of FIG. 3 that even if the incoming fish scale product stream 13 corresponds to the total output capacity of a modern day rotary printing press, there is still sufficient time to remove from one of the platforms 18 or 18' respectively, a finished built-up "spiral-shaped stack" S.

With the exemplary embodiment of apparatus illustrated in FIG. 3A, and in contrast to that shown in FIGS. 1 and 3, here the height of the platform upon which there is formed the stack S is not changed, rather there is changed the height of the outlet or outfeed portion 100 of the conveyor line, generally indicated by reference character 110.

In the showing of FIG. 3A this conveyor line 110 encompasses an infeed conveyor band 41 or the like (here shown in the form of a small band conveyor) which is driven by the drive means 112 so as to convey the fish scale product stream 13 in the direction indicated by the arrow 42. This infeed or delivery conveyor band 41 is trained about two deflecting rollers 43, 44, the deflecting roller 44 being mounted in a slot 46 formed in the frame 45 of the infeed conveyor band 41 so as to be rotatable and displaceable transversely with respect to its axis of rotation. A not particularly illustrated spring or equivalent biasing means serves to force the deflecting roller 44 into the right-hand position appearing in FIG. 3A. In order to insure that the conveyor band 41 will remain tensioned its return run is trained about a tensioning roller 47 as well as two further freely rotatable rollers or rolls 48, 49. The tensioning roller 47 which is likewise rotatable is mounted in a slot 50 so as to be displaceable transversely with respect to its axis of rotation and also is exposed to the action of a spring (not shown) or equivalent structure which strives to displace this tensioning roller or roll 47 towards the left of FIG. 3A.

The deflecting roller 44, which is at least driven by the wrapped around portion of the band 41*a* of the conveyor band 41, at the same time forms the deflecting roller or roll for a conveyor band 51 constructed as a band conveyor means and which bounds a conveyor or conveying channel 52 at its lower end. This conveyor channel 52 is bounded at its upper end by the lower run 53*a* of an endless band 53, this lower run 53*a* confronting the active conveying run 51*a* of the conveyor band 51. The endless band 53 is trained about the deflecting rollers or rolls 54 and 55. The deflecting roller located at the outfeed of the conveyor band 51 has been designated by reference character 56 and the deflecting roller located at the outfeed side of the conveyor band 53 has been designated by reference character 55. These deflecting rollers 55 and 56 are guided to be vertically and linearly displaceable as well as maintained at a constant spacing from one another in a frame or upright 57, wherein the guide means for such deflecting rollers 55 and 56 has been schematically indicated by reference character 114.

Following the conveyor channel 52 and constituting the last component of the conveyor line 110 is an outfeed or delivery band 59 which is mounted in an auxiliary frame 58 which extends over the platform 18 and the stack S which is in the process of being formed. This auxiliary frame 58 is guided to be vertically displaceable in any suitable manner in a further frame 60 which is essentially in parallelism with respect to the frame 57, and a counterweight can be provided in order to partially compensate the weight of the auxiliary frame 58 as well as the components which are mounted thereat. At a support 61 mounted at the auxiliary frame 58 there is mounted an elevationally adjustable double leg member 62 having the two legs 62*a*, at the lower ends of which there are freely rotatably mounted two contact or pressure rollers 63 and 64. The axes of rotation of the contact rollers 63 and 64 are angularly disposed with respect to one another, for instance as illustrated are at right angles to one another and intersect approximately at the region of the lengthwise axis of the stack S which is to be formed at the region of the rotational axis of the platform 18, respectively. These contact rollers 63 and 64, owing to the angular positioning of their rotational axes with respect to one another simultaneously function as deflecting means in order to deflect the arriving or incoming printed products out of the linear path of movement. Additionally the auxiliary frame 58 is always supported through the agency of the contact rollers 63, 64 at the upper side or face of the platform 18 and the stack S respectively. Thus, there is also elevationally positionally adjusted the outfeed or delivery band 59 as a function of the increasing size or growth of the stack S.

Between the auxiliary frame 58 and both of the deflecting rollers 55 and 56 there can be provided a mechanical connection, so that also these rollers can follow the lifting or elevational movement of the auxiliary frame 58. In the case under consideration, however, there is provided for the deflecting rollers 55 and 56 a separate lifting mechanism 116 which, for instance, can be turned-on and turned-off by means of a feeler or the like which scans or senses the elevational position of the auxiliary frame 58.

As already mentioned, with this exemplary embodiment the platform or platform member 18 is only driven in the sense of the arrow 21 like a rotatable disk, however is not adjustable in elevation. The drive of the platform 18 is effected through the agency of a drive motor 65 via a drive connection 66 which has only been schematically indicated in FIG. 3A by the dash-dot or phantom lines.

The drive motor 65 also drives a sprocket wheel of gear 67 and via such a sprocket chain 68 which is guided about a sprocket gear or wheel 69 rotatably mounted at the upper end of the frame 60. The chain 68 also meshes with a transmission gear 70 which is seated upon a transmission shaft 71 rotatably mounted in the auxiliary frame 58. Upon the transmission shaft 71, which can be blocked by means of the schematically shown electromagnetic brake 72 or equivalent structure, there is seated a further sprocket gear 73 from which extends a chain 74 which, in turn, drives through the agency of a sprocket gear 75 the deflection of deflecting roller 76 located at the inlet or infeed side.

During operation of the apparatus portrayed in FIG. 3A the conveyor line and the platform are driven in the sense of the arrows 42 and 21 respectively. In particular, the drive motor 65 is driven in that rotational direction which causes the chain 68 to travel in the direction of the arrow 77. Consequently, and as long as the transmission shaft 71 is not blocked, the outfeed or delivery band 59 is also driven. The height of the outfeed or discharge end of the conveyor line, namely the outfeed or delivery band 59, is automatically accommodated to the height of the growing stack S.

If the spirally-formed stack S has attained the desired height, for instance the height indicated in phantom lines in FIG. 3A, then the components 41 and 52 of the conveyor line are disconnected in order to suppress the further infeed of the fish scale product stream 13 to the platform 18. At the same time the transmission shaft 71 is blocked by means of the brake 72, which in turn brings about the result that also the delivery or outfeed band 59 is no longer driven and, on the other hand, that the auxiliary frame 58 is raised because the chain 68 now is in engagement with the blocked sprocket wheel or gear 70. As soon as the auxiliary frame 58 has reached its highest possible position (something which, for instance, is determined by a not particularly illustrated terminal switch), then, the motor 65 is also switched-off. Now the stack S can be pushed away from the platform 18, or, in the event that it is formed upon a pallet, then the formed stack S can be lifted off the platform with the aid of such pallet. Now the drive motor 65, for instance by reversing the polarity in the opposite direction is turned-on with the brake 72 still active, whereupon the auxiliary platform 58 and together therewith the conveyor channel 52 is lowered towards the platform. If the auxiliary frame 58 has reached its lowermost position (which likewise can be determined by a not particularly illustrated but conventional terminal switch), then, the brake 72 is vented i.e. rendered ineffectual and at the same time the direction of rotation of the motor 65 is reversed. Now there can begin a new stacking operation.

Continuing, in FIG. 4 there is illustrated in perspective view a "spirally-shaped stack" S which results when using the described embodiments of apparatus of this development. In order to enhance the illustration and the recognition of the configuration of the resulting stack all angular values in such stack and through which the successive printed products have been turned with respect to one another are the same. Such angle or angular value essentially is dependent upon the mutual spacing of the printed products in the fish scale product stream 13. These angular values are that much more uniform the more uniform the aforementioned spacing of the fish scale stream of products is from one another. On the other hand, a uniform spacing of successive printed products in the fish scale product stream is not an absolute requirement in order to build-up the spirally-shaped stack S shown in FIG. 4. In the stack S shown in such FIG. 4 there are present twenty-four printed products in each winding or coil of the spiral, and in the spiral there are present approximately ten such coils or windings, also known as helixes. Consequently, it will be recognized that in the stack S illustrated in FIG. 4 there are stacked approximately 240 individual printed products in a formation which is inherently stable. It is further to be recognized that is readily possible to build-up the stack of FIG. 4 further to twice the height without impairing its stability.

Figure 5:
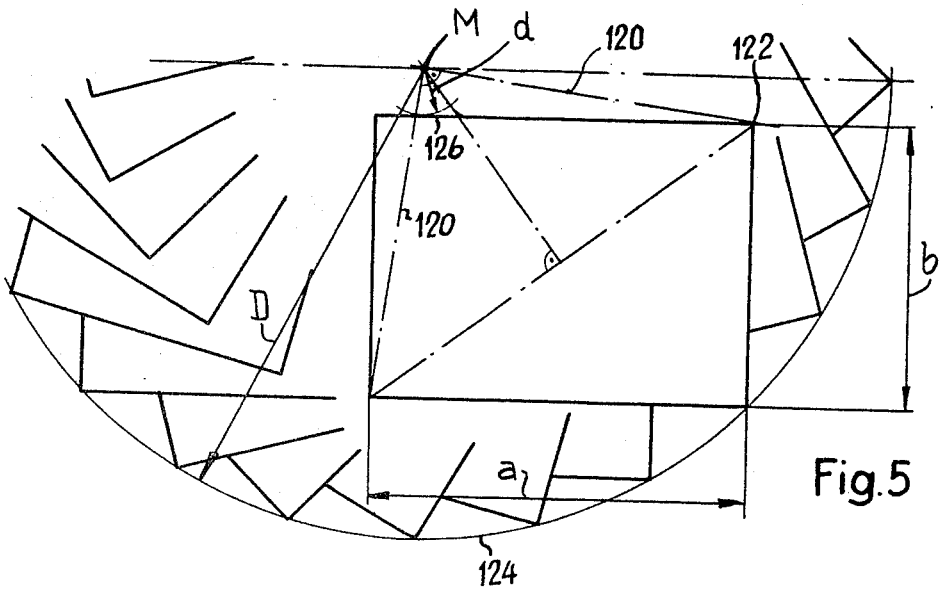
FIG. 5 is a fragmentary plan view of a part of the stack shown in FIG. 4 for the purpose of explaining a particularly advantageous arrangement of the individual printed products with respect to the mass of the stack related to the shape or format of the printed products.

Although basically the position of the individual printed products with relation to the lengthwise axis M of the spiral i.e. the spiral-shaped stack is of subordinate significance, it has been found that optimum results can be realized with respect to utilization of the space and the stability of the spiral-shaped stack if, as shown in FIG. 5, this reference position is chosen such that, viewed from the axis M of the spiral, both pairs of diagonally oppositely situated corners of a printed product each appear at a right angle. In other words, the straight lines 120 extending from the central axis M to diagonally opposite corners 122 substantially enclose a right angle, as shown. If this condition is maintained then the outer cylindrical envelope surface 124 of the stack possesses a diameter D, wherein there is present the relationship $D=\sqrt{2}(a+b)$, whereas the inner cylindrical envelope surface 126 of the stack S possesses a diameter d, wherein there prevails the relationship $d=(a-b)$. In the foregoing equations the symbols a and b represent the respective side lengths of the shape of the printed product as best seen by referring to FIG. 5. Furthermore, it has been found that when folded printed products are delivered with the main fold emanating from the corner of such product contacting the inner envelope surface of the stack, the cover surface of the stack remains essentially flat notwithstanding the varying thickness of the printed product. This is so because when maintaining this condition, the folds of successive printed products only come to bear in superimposed relationship at one point and experience a considerable compression. However, the stack according to the showing of FIGS. 4 and 5 essentially forms a structure, which, apart from the weight, can be easily loaded onto pallets and can be transported within the plant without the need for additional binding or tying operations or other securing operations. If the formed stack is transported outside of the plant then it is recommended to weight the top of the stack.

A stack formed according to the method aspects of this development can again be destacked in a number of different ways. Firstly, it is readily possible to separate the individual printed copies out of the stack since each printed copy in the stack offers a surface which can be seized and removed. To this end the stack need only be coaxially placed upon a rotatable support. A further technique for destacking a stack formed according to the method of the invention has been schematically illustrated in FIGS. 6 to 8. This destacking technique aims at again reestablishing the fish scale formation which was not completely annihilated during the stacking operation, i.e., to again transform the printed products in principle into a similar fish scale product stream just as such were delivered. Equipment which is extremely suitable for such type destacking operations constitute the subject matter of the commonly assigned, copending United States application Ser. No. 578,040, filed May 16, 1975, entitled "Apparatus for Destacking A Substantially Spiral-Shaped Formed Stack of Printed Products", listing as the inventors Felix Dietrich and Werner Honegger, the latter mentioned inventor being one of the co-inventors of this development, and to which application reference may be readily had and the disclosure of which is incorporated herein by reference. In order to readily appreciate the possibilities for destacking such spiral-shaped stack according to the last-mentioned technique and with equipment of the type disclosed in the above-mentioned copending United States application, reference will now be made to FIGS. 6 to 8 illustrating such destacking operation.

The apparatus schematically portrayed in FIGS. 6 to 8 in development views, and serving to destack the spiral-shaped stack S, will be understood to essentially comprise a substantially circular ring-shaped roller track 30 having a multiplicity of conical rollers 31 which extend radially outwardly from the center of the roller track 30, and such conical rollers 31 can be freely rotatable or driven in the direction of the arrow 32. The taper or conicalness of the rollers 31 and their arrangement is undertaken such that the totality of such ray-shaped arranged rollers 30 form an essentially flat and circular ring-shaped support surface. The flat support surface, however, is interrupted by a circular sector-shaped outlet or throughpassage 33. At the one roller 31' which bounds at such throughpassage 33 there merges a conveyor band 36 guided over the rollers 34 and 35, whereas the other conical roller 31'' bounding such throughpassage or outlet opening 33 has arranged forwardly thereof a deflector-or guide body 37. Merging at the conveyor band 36 is a further conveyor band 39 driven in the direction of the arrow 38.

Now if there is coaxially placed upon the roller track 30 a spiral-shaped stack S and if such is placed into rotation in the direction of the arrow 40, then this stack initially rotates without it being destacked, and the printed products of the stack which are located just over the throughpassage or outlet opening 33 are held by the leading and trailing printed product supported at the roller track 30 without such being able to pass through the throughpassage or outlet opening 33. This condition has been portrayed in FIG. 6. However, as soon as the first printed product of the first coil or helix of the stack has reached the opening 33 it comes to bear upon the conveyor band 36, partially owing to its own weight and partially due to the pressure of the trailing printed products which bear thereupon, it being possible for such first printed product to move through the opening 33 because the same does not have any printed product located ahead of it which would support its leading edge. This condition has been portrayed in FIG. 7. The second printed product follows the first, the third the second and so forth. In this way the individual coils of the spiral-shaped stack S are so-to-speak unwound from the support surface of the stack and transferred to linearly traveling or extending conveyor tracks or conveyor means, so that the deflection of the individual printed products brought about when forming the stack is reformed and, possibly, with the aid of so-called lateral straighteners (not shown) there is again formed upon the conveyor band 31 or the like a linearly extending fish scale product stream 13'. This condition has been illustrated in FIG. 8.

While there are shown and described present preferred embodiments of the invention, it is to be distinctly unerstood that the invention is not limited thereto, but may be otherwise variously embodied and practiced within the scope of the following claims. ACCORDINGLY,

What we claim is:

1. An apparatus for stacking flat printed products arriving in a continuous imbricated stream into a substantially spiral-shaped stack, comprising:

conveying means for conveying said imbricated stream, said conveying means having an outfeed portion;

a rotatable stack support defining a substantially plane support surface and having an axis of rotation;

means for rotating the stack support about its axis of rotation;

said stack support being positioned below said outfeed portion;

said outfeed portion being directed along a substantially straight line path in a direction radially offset with respect to said axis of rotation;

deflection means operatively associated with said stack support and arranged downstream with respect to said outfeed portion;

said deflection means individually deflecting each of the printed products delivered by said outfeed portion in the plane of each such printed product so as to form a spiral-shaped stack which comprises a plurality of successive windings, each of which has printed products partially overlapping one another;

said deflection means including stop means positioned to engage an edge of each infed printed product and pressure exerting means radially offset from and effective at least substantially in the direction of said axis of rotation;

means to move said outfeed portion relative to said stack support in a direction parallel to said axis of rotation; and wherein said stop means is arranged at the region of the axis of rotation of the stack support and includes a detachably mounted tube arranged at the stack support, said tube serving as a core for the spiral-shaped stack.

2. The apparatus as defined in claim 1, wherein: said stack support is elevationally stationary in position, the outfeed portion of said conveyor means being arranged ahead of said stack support with respect to the direction of conveying of the imbricated product stream.

3. An apparatus for stacking flat printed products arriving in a continuous imbricated stream into a substantially spiral-shaped stack, comprising:

conveying means for conveying said imbricated stream, said conveying means having an outfeed portion;

a rotatable stack support defining a substantially plane support surface and having an axis of rotation;

means for rotating the stack support about its axis of rotation;

said stack support being positioned below said outfeed portion;

said outfeed portion being directed along a substantially straight line path in a direction radially offset with respect to said axis of rotation;

deflection means operatively associated with said stack support and arranged downstream with respect to said outfeed portion;

said deflection means individually deflecting each of the printed products delivered by said outfeed portion in the plane of each such printed product so as to form a spiral-shaped stack which comprises a plurality of successive windings, each of which has printed products partially overlapping one another;

said deflection means including stop means positioned to engage an edge of each infed printed product and pressure exerting means radially offset from and effective at least substantially in the direction of said axis of rotation;

means to move said outfeed portion relative to said stack support in a direction parallel to said axis of rotation;

said stack support being elevationally stationary in position, the outfeed portion of said conveyor means being arranged ahead of said stack support with respect to the direction of conveying of the imbricated product stream; and wherein the outfeed portion of the conveyor line is mounted in a frame, said frame being provided with rollers supported upon said stack support and upon the top surface of the spiral-shaped stack formed thereon.

4. The apparatus as defined in claim 3, further including:

an upright frame member at which there is vertically displaceably guided said frame provided with said rollers.

5. The apparatus as defined in claim 1, wherein:

said pressure exerting means includes at least one pressure roller means.

6. The apparatus as defined in claim 5, further including:

drive means for driving said pressure roller means.

7. The apparatus as defined in claim 1, wherein:

the outfeed portion of the conveying means has laterally unguided edges along its entire lengthwise extent.

* * * * *